US006290049B1

(12) United States Patent
Nikolayev

(10) Patent No.: US 6,290,049 B1
(45) **Date of Patent: *Sep. 18, 2001**

(54) DATA GENERATING DEVICE FOR BULK VENDING MACHINES

(75) Inventor: Nikolay Nikolayev, Flushing, NY (US)

(73) Assignee: Nova Resolution Industries, Inc., Bronx, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/420,357

(22) Filed: Oct. 18, 1999

Related U.S. Application Data

(63) Continuation-in-part of application No. 09/174,785, filed on Oct. 19, 1998, now Pat. No. 6,050,385.

(51) Int. Cl.[7] ..... G07F 5/02; G07F 11/00

(52) U.S. Cl. ..... 194/202; 194/239; 194/255; 221/7

(58) Field of Search ..... 194/236, 237, 194/239, 243, 255, 292, 202; 221/7; 453/32

(56) References Cited

U.S. PATENT DOCUMENTS

| | | | |
|---|---|---|---|
| 1,355,583 | 10/1920 | Zeidler . | |
| 1,926,652 | 9/1933 | Rosenfeld . | |
| 2,818,213 | 12/1957 | Pearl . | |
| 3,156,340 | 11/1964 | Arkes | 194/29 |
| 3,211,267 | 10/1965 | Bayha . | |
| 3,783,986 | 1/1974 | Bolen . | |
| 4,143,749 | 3/1979 | Otten . | |
| 4,216,461 | 8/1980 | Werth et al. . | |
| 4,350,239 | 9/1982 | Tsuiki | 194/236 |
| 4,369,442 | 1/1983 | Werth et al. . | |
| 4,376,479 | 3/1983 | Sugimoto et al. . | |
| 4,392,564 | 7/1983 | Hayashi . | |
| 4,566,033 | 1/1986 | Reidenouer . | |
| 4,981,024 | 1/1991 | Beldham . | |
| 5,174,427 | 12/1992 | Glaser . | |
| 5,201,396 | 4/1993 | Chalabian et al. . | |
| 5,386,901 | 2/1995 | Ibarrola et al. . | |
| 5,755,618 | 5/1998 | Mothwurf . | |

*Primary Examiner*—Robert P. Olszewski
*Assistant Examiner*—Bryan Jaketic
(74) *Attorney, Agent, or Firm*—Michael R. Gilman; Kaplan & Gilman, LLP

(57) ABSTRACT

A data generating device 300 for use in combination with a coin mechanism 100 of a bulk vending machine 10, is provided. The combination uses a standard coin mechanism of a bulk vending machine, which in its normal operation is received into an opening in the bulk vending machine. The coin mechanism has a selectively rotatable shaft 110 extending axially therefrom, which has mounted therearound, a portion of the data generating device. The data generating device has a contact switch assembly 230, comprising a first pair of spaced-apart wires 236/238 at a first location of the switch assembly, the first pair of wires connected to a data compilation/transfer device 310 by a lead wire 241 and to a capacitor by another lead wire 243, a second pair of spaced-apart wires 242/244 at a second location of the switch assembly, the second pair of wires connected at least to the capacitor by yet another lead wire 247, a selectively rotatable element 260 having a metal strip 266 attached thereto, the metal strip able to connect both of the wires of both of the first and second pairs of the spaced-apart wires at separate and distinct positions during the selective rotation of the selectively rotatable element, wherein the shaft causes the selectively rotatable element to rotate bringing the metal strip first in contact with the first pair of spaced-apart wires and then in contact with the second pair of spaced-apart wires, thereby causing the compilation of data.

48 Claims, 7 Drawing Sheets

DATA GENERATING DEVICE FOR BULK VENDING MACHINES

This application is a continuation-in-part of application Ser. No. 09/174,785, filed Oct. 19,1998, now U.S. Pat. No. 6,050,385.

BACKGROUND OF THE INVENTION

This invention relates to the field of bulk vending machines, and more particularly. to a data generating device for a standard bulk vending machine coin mechanism.

Both vending machines and bulk vending machines are old in the art. Vending machines are normally associated with those machines used for dispensing a particularly chosen item to a user of the machine. For example, a user of a vending machine will insert the required amount of money, represented by coins or bills, into the machine and will then have an opportunity to select from a variety of different items. These items can include different types of snacks (candy bars, potato chips, pretzels, gum, breath mints, etc.), drinks (soda, fruit juices, water, etc.) and ice cream (sandwiches, pops, cones, etc.).

In contrast, a bulk vending machine does not normally lend itself to giving the user of a machine a choice between the goods to be selected, and is normally operated with coins only. In general, bulk vending machines hold large quantities of a particular type of item (gum balls, nuts, trail mix, toys, balls, etc.) in a large top mounted receptacle. By placing a coin into the coin mechanism of the bulk vending machine, and turning the handle, one, or a handful, of the items within the receptacle are dispensed down a chute for receipt by the user. In these machines, no choice has been given to the user, and the user will receive whichever item, or items, are next in line to be dispensed. Parents will now clearly understand the distinction between vending machines and bulk vending machines; vending machines give their child a choice and the child walks away happy and content, while bulk vending machines distribute what they want to the awaiting hands of the child, and no matter how much screaming and ranting by the child, he/she will have to eat the blue gum ball, even though he/she really wanted a green gum ball.

Another important distinction between vending machines and bulk vending machines, is that vending machines are normally AC powered units which are plugged into a wall outlet, while bulk vending machines are almost never electrically powered. This makes bulk vending machines safer to use, and allows for their placement in any location.

In the history of the bulk vending industry there has been no effective way of (1) counting the money received into bulk vending machines or (2) displaying that information in a format which is easy to use and manipulate.

Today's standard methods for determining the amount of vends which have occurred, and the coins inserted into a given machine during a certain period of time, are by hand-held coin counters and weight scales. These methods make the collection process very time consuming and leave no hope for any sense of security, nor for the possibility of building any kind of financial history for the particular machine by the owner or lease holder of the machine.

As is evidenced by the counting mechanisms of U.S. Pat. Nos. 5,201,396, 4,392,564, 4,376,479,4,369,442,4,216,461 and 4,143,749, the prior art discloses attempts to insert counters, usually into vending machines, but sometimes into bulk vending machines. These prior art counters have the disadvantages of requiring a separate AC power source and the need of an associated power converter to provide the low voltage power needed to the meter. These prior art counters also disclose mechanisms having computers attached thereto, mechanisms for determining the value of the coins deposited, and mechanisms for counting the value of the items exiting the machine. All of these counters are hindered by deficiencies in size, power source and the complicated nature of their operation.

Additional prior art is U.S. Pat. No. 3,783,986 to Bolen, which shows a complicated counter for bulk vending machines, wherein the counter is specifically not attached to the coin mechanism of the machine, which requires a hole to be cut into the back of the machine, and which, while being a good attempt to resolve an industry-wide problem, nevertheless has a counter which is too far removed from, and connected by too many gears to, the coin mechanism.

The bulk vending industry is, despite the Bolen counter, still crying out for a small, self powered (not requiring an external AC power source) counting mechanism for its bulk vending machines. Accordingly, it would be desirable to provide a coin mechanism and/or coin mechanism and data generating device combination for a bulk vending machine which, preferably, needs no external AC power source, is sized so as to fit within the restricted space limitations of a bulk vending machine without needing to cut a hole in the machine, is accurate, is easily read, is not able to be tampered with, is easily installed and maintained, and is capable of allowing the user to download the data for use in spreadsheet-like print outs.

SUMMARY OF THE INVENTION

In accordance with the invention, a data generating device for use in combination with a coin mechanism of a bulk vending machine is provided.

The combination uses a standard coin mechanism of a bulk vending machine which in its normal operation is received into an opening in the bulk vending machine, and a data generating device in working relation with the coin mechanism. The coin mechanism has a selectively rotatable shaft extending axially therefrom which has mounted therearound. a portion of the data generating device. The data generating device has a contact switch assembly, comprising a first pair of spaced-apart wires at a first location of the switch assembly, the first pair of wires connected to a data compilation/transfer device by a lead wire and to a capacitor by another lead wire, a second pair of spaced-apart wires at a second location of the switch assembly, the second pair of wires connected at least to the capacitor by yet another lead wire, a selectively rotatable element having a metal strip attached thereto, the metal strip able to connect both of the wires of both of the first and second pairs of the spaced-apart wires at separate and distinct positions during the selective rotation of the selectively rotatable element, wherein the shaft causes the selectively rotatable element to rotate bringing the metal strip first in contact with the first pair of spaced-apart wires and then in contact with the second pair of spaced-apart wires, thereby causing the compilation of data.

Accordingly, it is an object of the invention to improve a standard bulk vending machine coin mechanism by placing it in combination with a data generating device.

Still another object of the invention is to improve a standard bulk vending machine coin mechanism through placement of the combination coin mechanism and data generating device within the limited space provided in a bulk vending machine.

Still a further object of the invention is to provide security and peace of mind to the owner/lease holder of bulk vending machines by enabling them to have independent, accurate and non-tamperable results of the counting of coins deposited into a bulk vending machines.

Other objects of the invention will in part be obvious and will in part be apparent from the following description.

The invention accordingly comprises assemblies possessing the features, properties and the relation of components which will be exemplified in the products hereinafter described, and the scope of the invention will be indicated in the claims.

BRIEF DESCRIPTION OF THE DRAWINGS

For a fuller understanding of the invention, reference is made to the following description taken in connection with the accompanying drawings, in which.

DETAILED DESCRIPTION OF THE PREFERRED EMBODIMENTS

Figure 1:
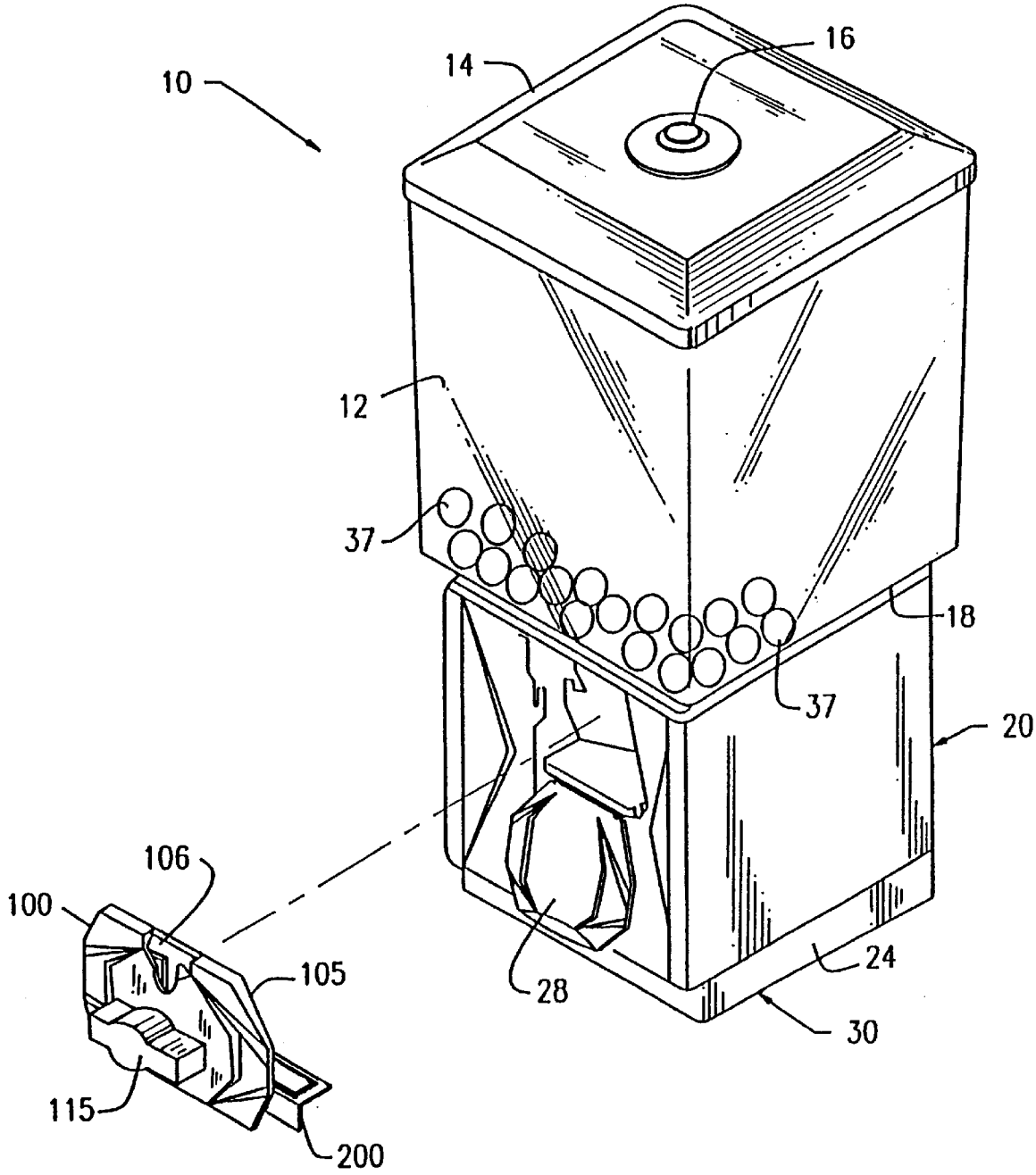
FIG. 1 is a perspective view of a bulk vending machine with an exploded view of the placement of the coin counter/combination coin mechanism and coin counter.
Figure 2:
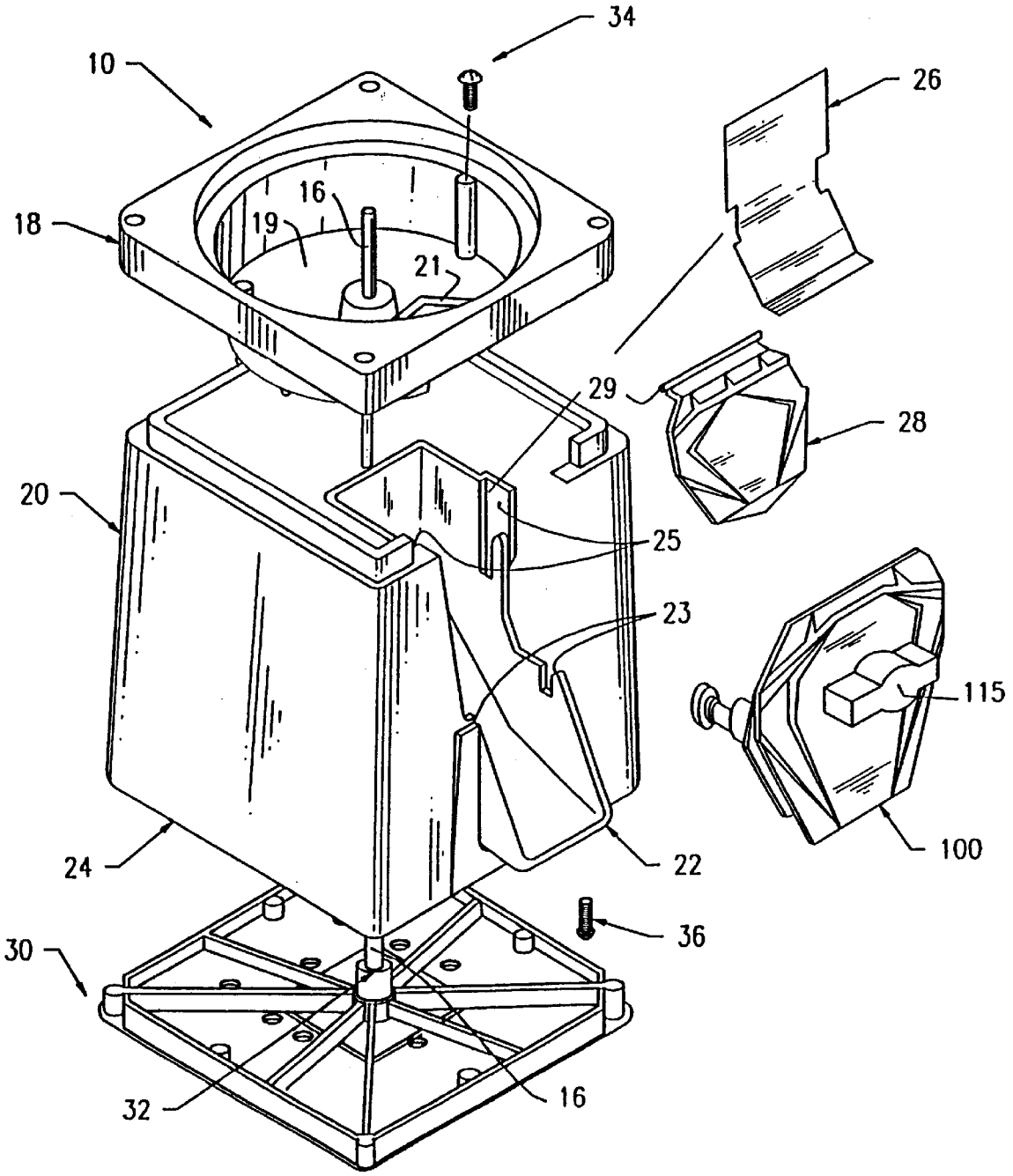
FIG. 2 is an exploded perspective view of a second embodiment of a bulk vending machine.

Referring first to FIGS. 1 and 2, two different, although very similar looking and functioning, bulk vending machines are shown at 10. For purposes of this application, bulk vending machines 10 of FIGS. 1 and 2, will be considered equivalent. Together they show a machine, having a top bulk receptacle 12 having a lid 14 and a bolt 16. The base of both machines 10 have a hopper 18, a body 20, a dispensing chute 22, a coin retainer base 24, a chute shield 26, a chute cover 28 and a coin mechanism 100.

In general, machine 10 has a base 30 into which bolt 16 extends to be secured by nut 32.

Receptacle 12 is held to hopper 18 by screws 34. Coin retainer 24 is held to the bottom of base 20 by screws 36. Chute shield 26 is secured onto chute 22 in notches 25, while chute cover 28 is rotatingly secured to chute 22 by rod 29 of cover 28 resting within notches 23 of chute 22.

Hopper 18 has a base 19 into which dispensing materials (for example, gum balls 37, see FIG. 1) are placed.

Hopper 18 has an opening 21 extending through base 19. Opening 21 is the passageway through which gum balls 37 pass to exit machine 10 through chute 22. As will be discussed in more detail below with regard to FIG. 3, coin mechanism 100 has a sprocket 150, which when rotated due to a user of machine 10 turning handle 115 of coin mechanism 100, causes a product wheel (not shown) to rotate. The product wheel has at least one opening which for each rotation of handle 115 corresponds with opening 21 of hopper 18, to allow for dispensing of one gum ball 37, or multiple quantities of such items as nuts, trail mix, M&Ms, etc.

Figure 3:
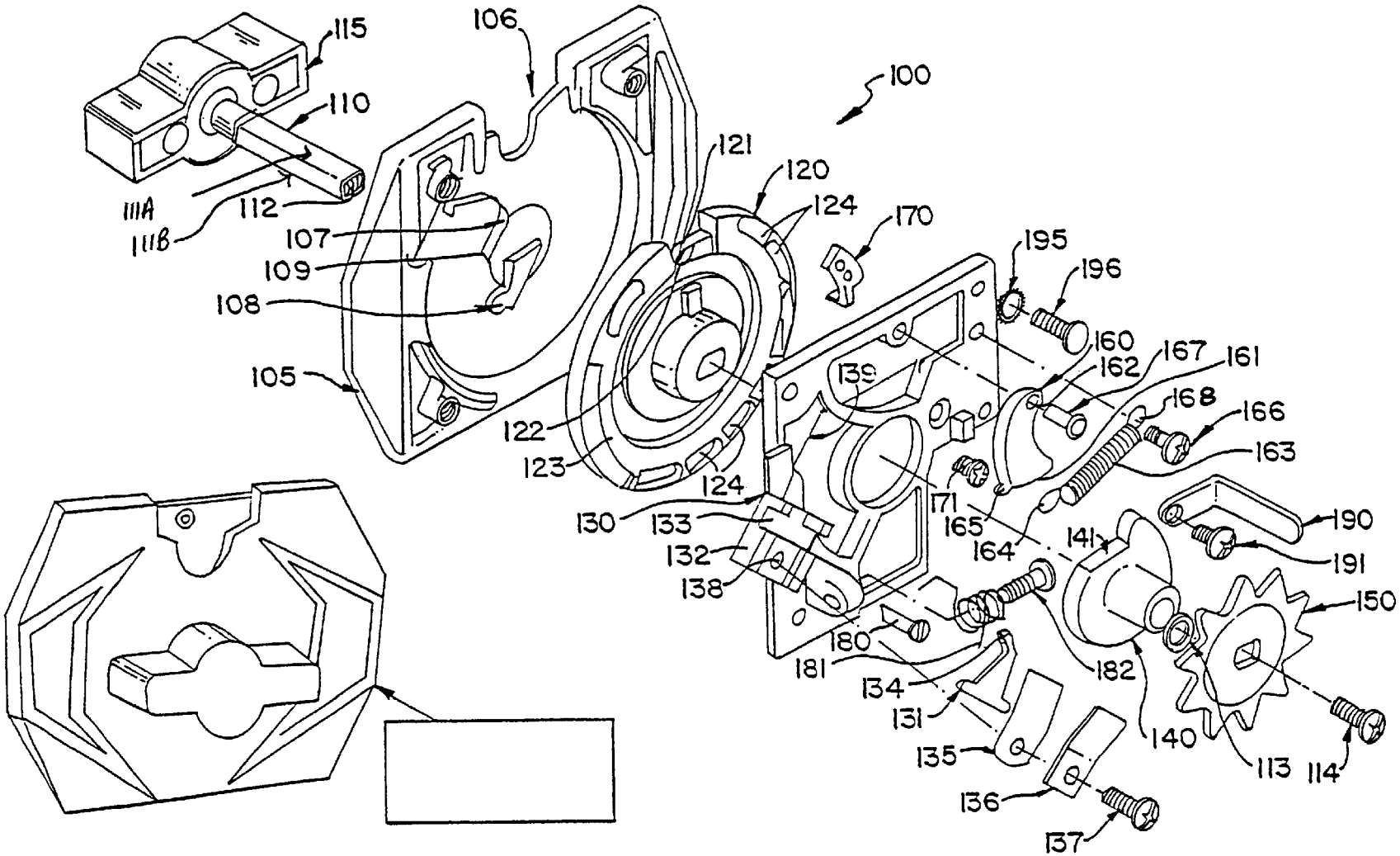
FIG. 3 is an exploded perspective view of the workings of a bulk vending machine coin mechanism.

Turning now to FIG. 3, an exploded view of a standard coin mechanism for a bulk vending machine is shown at 100. It is to be understood that the use of differently constructed coin mechanisms is anticipated by the invention.

Coin mechanism 100 has a front plate 105, shaft 110, handle 115, coin wheel 120, back plate 130, cam 140 and sprocket 150. Shaft 110 is axially located through all of the stated elements, and secures said elements together through use of threads 112 in shaft 110 and washer 113 and nut 114. Shaft 110 is also usually shaped in cross-section having at least one flat edge 111, with the rest being circular in cross-section, while the one of FIG. 3 actually has two such flat edges 111A and 111B. At the end of shaft 110, opposite threads 112, is handle 115. As seen earlier in FIGS. 1 and 2, handle 115 is one of the few parts of coin mechanism 100 which is exterior to bulk vending machine 10, and is the part that a user of bulk vending machine 10 uses after insertion of coins to receive his/her treat.

Continuing with FIGS. 1 and 3, front plate 105 of coin mechanism 100 has a coin receiving slot 106. In use, a user of bulk vending machine 10 inserts a coin (usually a quarter) into slot 106 of front plate 105. Once the quarter is inserted through slot 106, it comes to rest within slot 121 of coin wheel 120 (see FIG. 3), where it sits upon curved ridge 122. In its position on curved ridge 122, a quarter will turn with coin wheel 120 when handle 115 is rotated.

In operation, coin mechanism 100 operates as follows:

1. As previously discussed, a coin is placed within slot 106 of front plate 105, to rest upon curved ridge 122 of slot 121 of coin wheel 120.
2. Handle 115 is rotated, usually in a clockwise direction, where the coin undergoes its first test of authenticity. The coin first comes into contact with coin pawl spring 107 and coin pawl 108. As coin wheel 120 is rotated, the coin pushes end 109 of coin pawl spring 107 upward. Assuming the coin has a proper diameter, end 109 of coin pawl spring 107 will sufficiently rise, thereby disengaging coin pawl 108 from locking coin wheel 120 in position. Coin wheel 120 will thereafter be free to continue its rotation.
3. The coin next encounters washer pawl 131, which is secured within washer pawl mount 132, having a receiving notch 133.

Washer pawl 131 is held within slot 133 of mount 132 by washer pawl spring 135, washer pawl retainer 136 and washer pawl retainer screw 137. Washer pawl retainer screw 137 screws into mount 132 at threaded opening 138. When secured in place, washer pawl 131 has its end 134 extending through opening 139 of back plate 130. While coin pawl 108 was responsible for authenticating the diameter of the coin, washer pawl 131 is the item which authenticates the thickness of the coin.

In operation, end 134 of washer pawl 131 runs against inside surface 123 of coin wheel 120. As can be seen at slot 121, with no coin in coin mechanism 100 (if for some reason coin wheel 120 somehow turned passed coin pawl 108), coin wheel 120 would be prevented from turning further due to end 134 of washer pawl 131 entering into slot 121 of coin wheel 120. In this position, slot 121 would hit against end 134, causing coin wheel 120 to halt in its rotation. Similarly, if the thickness of the coin was too thin, end 134 would slide off of surface 123 down to the surface of the coin, and would again touch part of slot 121, preventing further rotation of coin wheel 120. In contrast, if the coin were too thick, end 134 of washer pawl 131 would hit into the edge of the coin, and coin wheel 120 would at that point be prevented from rotating further. Only when the coin is of the proper thickness, will end 134 run smoothly between surface 123 and the surface of the coin, thereby allowing coin wheel 120 to continue its rotation.

4. The final pawl of coin mechanism 100 is return pawl 160. Return pawl 160 has a bottom side 161 and a substantially curved side 162. When cam 140 is in its resting position (between uses), it is the position shown in FIG. 3. In this position, surface 161 of return pawl 160 rests upon flat surface 141 of cam 140.

Figure 8:
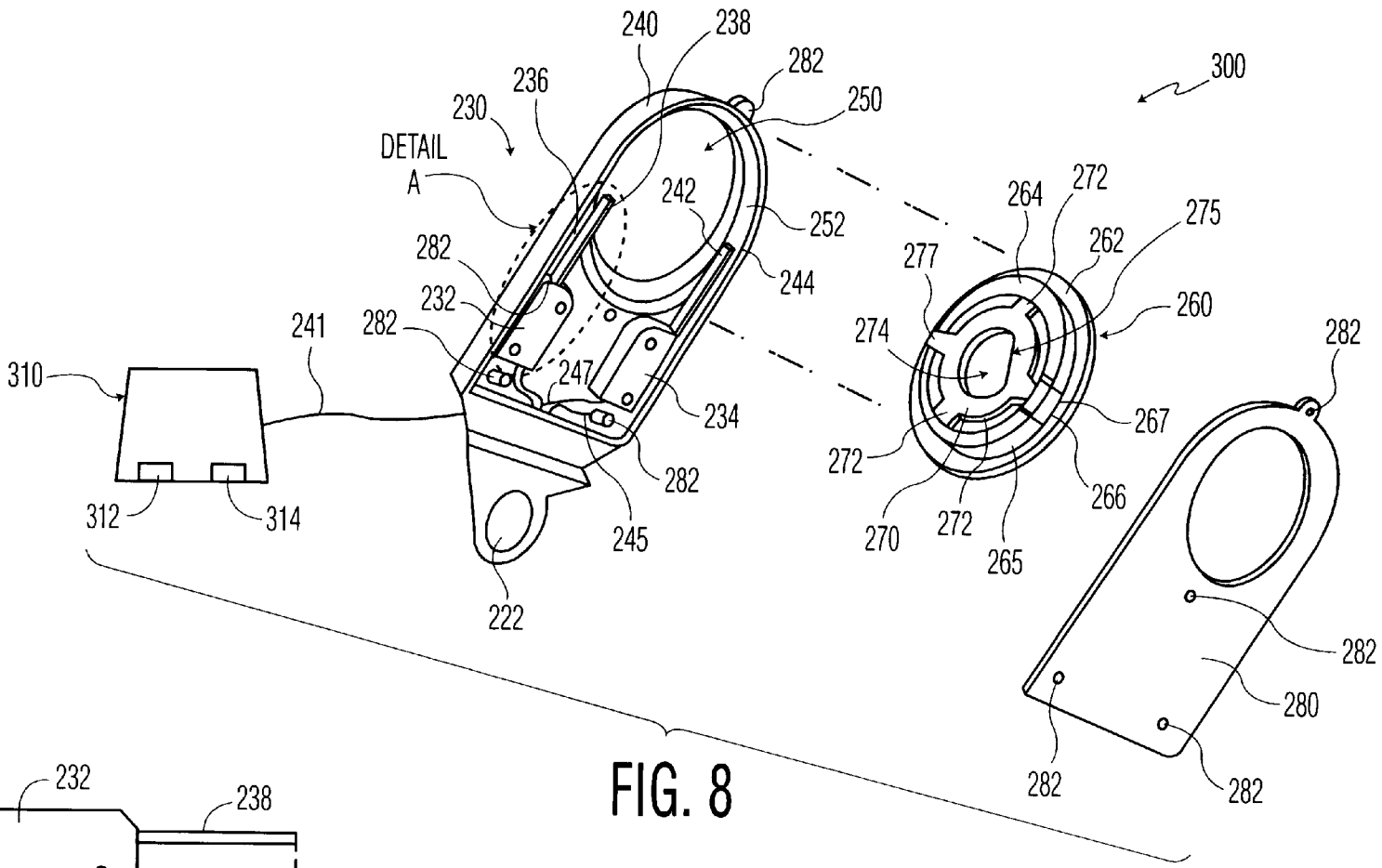
FIG. 8 is an exploded perspective view of another embodiment of the counter assembly made in accordance with the invention.
Figure 8A:
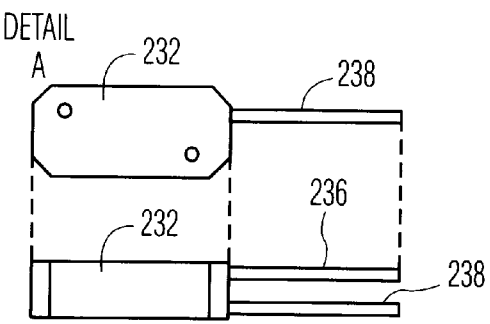

Return Pawl 160 is pulled to its at rest position shown in FIG. 3 by spring 163 having first and second loops 164 and 168. loop 164 is received around protrusion 165 of return pawl 160, and spring 163 is secured to back plate 130 by screw 166. Accordingly, tension from spring 163 maintains pawl 160 in its at rest position, as shown in FIG. 8.

Return pawl 160 is riveted into back plate 130 by return pawl rivet 167, to enable return pawl 160 to pivot.

5. Attached at the end of shaft 110, between cam 140 and bolt 114, is sprocket 150, which as previously discussed, turns the product wheel (not shown) which allows for the dropping of treats, such as gum balls 37, from receptacle 12 of bulk vending machine 10 into chute 22 for receipt by a user of machine 10.
6. Continuing with the progress of the coin as coin wheel 120 rotates, after the, coin passes washer pawl 131, coin wheel 120 is easily turned until slot 121 is in its starting position aligned with slot 106. It is in this position where return pawl 160 and cam 140 are in their at rest position, as previously discussed.

However, prior to coin wheel 120 being returned to its starting point, the coin is deflected by coin kickout 170 out from slot 121 and into coin retainer 24. Coin kickout 170 is secured to back plate 130 through use of screw 171.

Some final notes regarding the structure of coin mechanism 100, as shown in FIG. 3. First, coin wheel 120 has a plurality of notches 124 into which stroke pin 180 are received. The purpose of notches 124 and stroke pin 180 is to prevent coin wheel 120 from being turned counter-clockwise, so that the user can retrieve his/her coin. In particular, you will note that the bottom surfaces of notches 124 are slanted. Accordingly, it is obvious that stroke pin 180 will slide out from notches 124 along the bottoms of notches 124, from one notch to the next as coin wheel 120 is rotated in a clockwise direction. However, it is equally obvious that stroke pin 180 will hit against the ridges of notches 124, should the user attempt to rotate coin wheel 120 in a counter-clockwise direction.

Stroke pin 180 is held in place through a slot (not shown) in back plate 130 by a spring 181 and screw 182.

Figure 4:
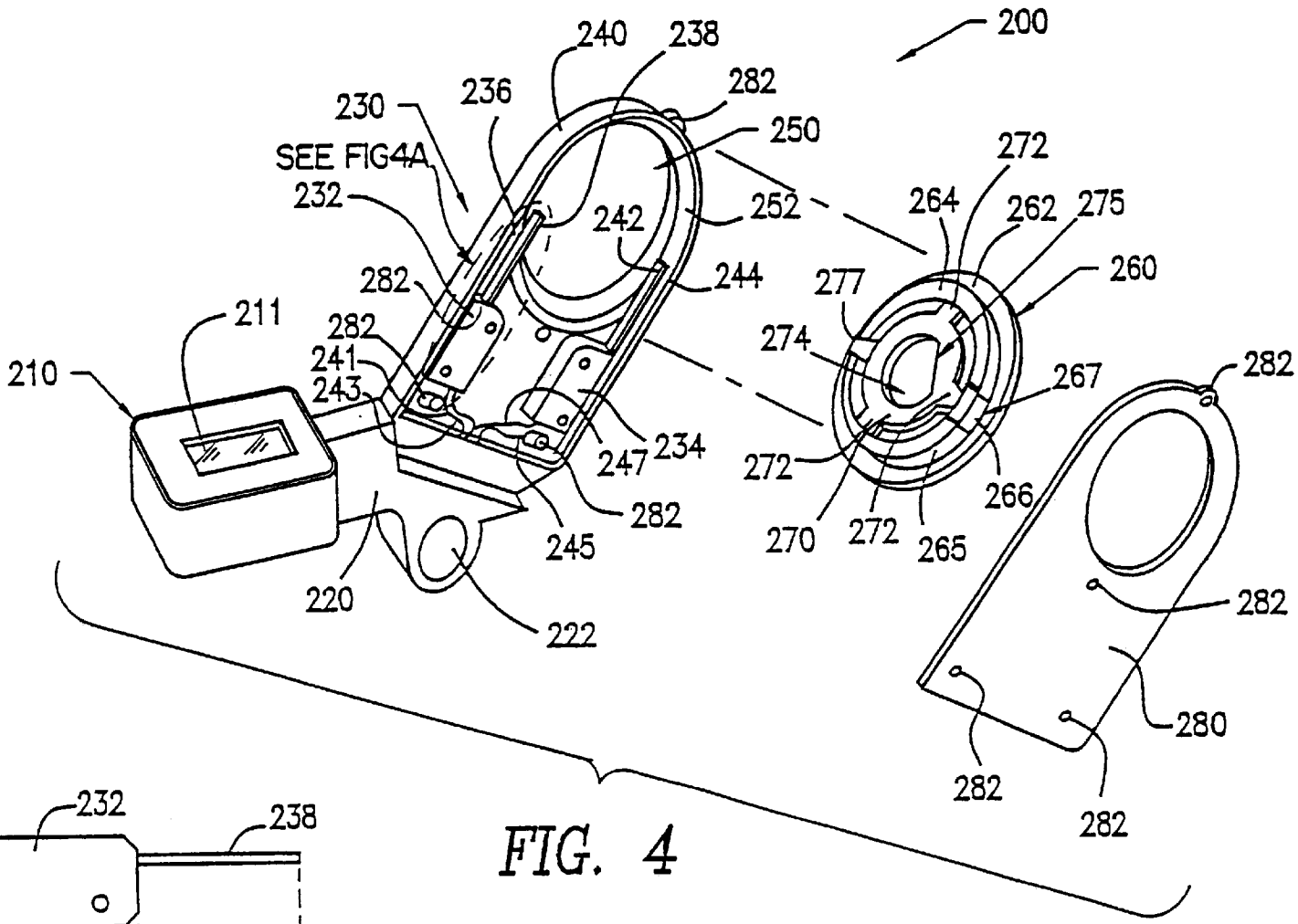
FIG. 4 is an exploded perspective view of a counter assembly made in accordance with the invention.
Figure 4A:
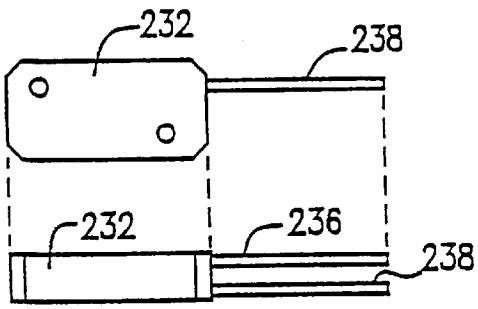
Figure 5:
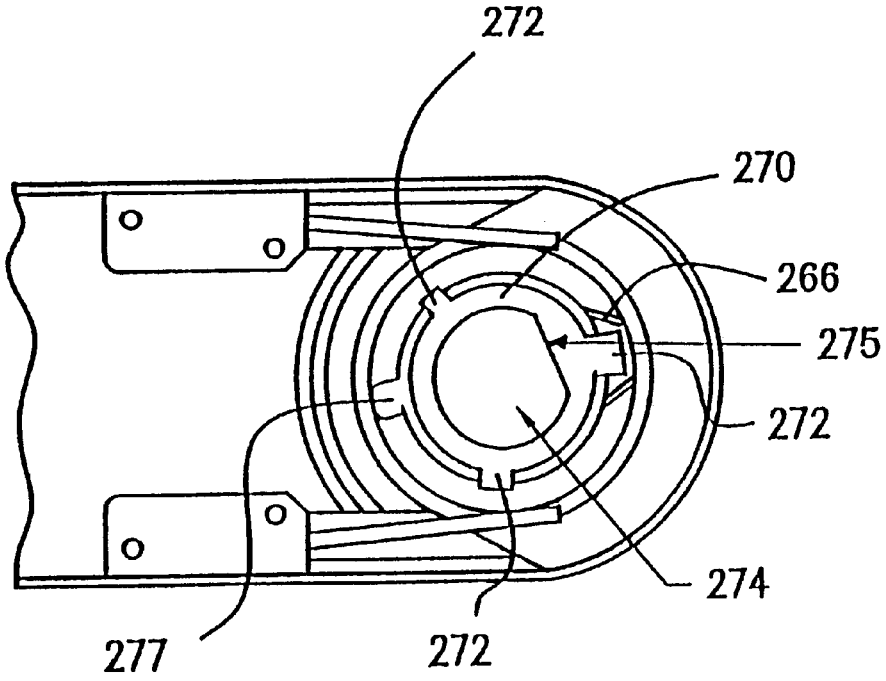
FIG. 5 is a top plan view of the contact switch mechanism of the invention.
Figure 6:
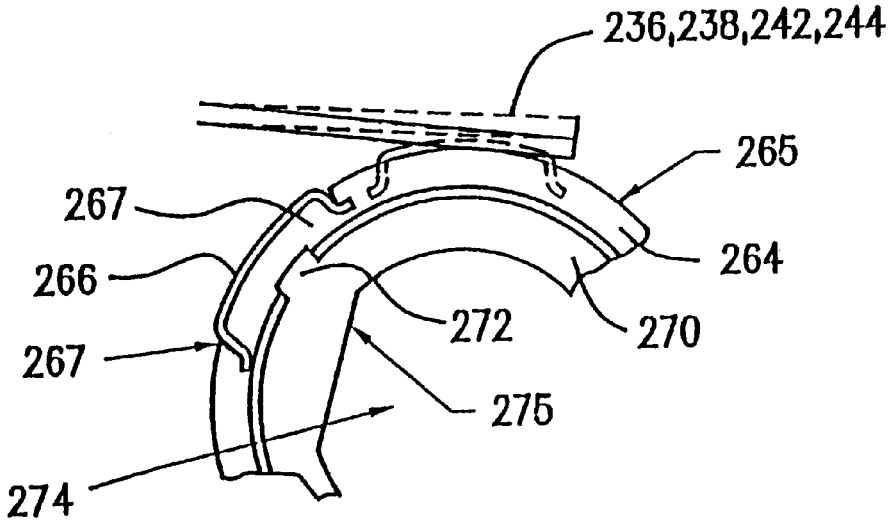
FIG. 6 is a close-up top plan view of contact being made in the switch mechanism of FIG. 5.

Next regarding FIG. 3., coin mechanism 100 is retained within body 20 of bulk vending machine 10 by use of latch 190, which is secured to back plate 130 by a screw 191. Latch 190 is selectively rotatable from its locked position (shown in FIG. 3) to an unlocked position, 90° from the position shown in FIG. 3. Finally for FIG. 3, front plate 105 and back plate 130 are secured together through use of washers and bolts 195 and 196. We turn now to a discussion of counter 200 (as seen in FIGS. 4–6), and to how counter 200 operates in relation to coin mechanism 100. Coin counter 200 has a numeric display 210, preferably having an LCD display 211, a bracket assembly 220 and a switch 230. Display 210 is mounted on bracket 220, as is switch 230. Switch 230 is connected to display 211 through at least one lead (not shown), which at least one lead is held within bracket assembly 220.

Bracket 220 is specially designed and configured to fit onto coin mechanism 100, on back plate 130, without interfering or in any way hindering the standard operation of coin mechanism 100. In fact, as will be discussed immediately below, bracket 220, and therefore counter 200, are so designed as to allow switch 230 to interact with shaft 110, and its flat edge(s) 111, during normal rotation of shaft 110 and the normal operation of coin mechanism 100.

Bracket 220 is attached to plate 130 of mechanism 100 through use of one of the screws used to make mechanism 100; screws 137, 166,191 or 196. Since there are many different coin mechanisms used in the bulk vending industry today, it is anticipated by the invention that any such existing screws of the mechanism can be used to connect counter 200 with the mechanism. It is also anticipated, although less desirable, to add a new screw to the mechanism to attach counter 200 to the mechanism. Whichever screw is used, it is inserted through chamber 222 of bracket 220.

As seen in FIG. 4, switch 230 has a main body portion 240, a rotating contact portion 260 and a cover 280. Most of body 240, rotating contact portion 260 and cover 280 are made from extruded or molded plastic, which is strong, cheap to produce, able to be molded/extruded into any shape and light weight; such plastic also does not interfere with the manner of functioning of the counter, as will be discussed below. Cover 280 is attached to body 240 through use of three screws (not shown) insert through screw holes 282. It is of course anticipated that any number of screws can be used to attach cover 280 to body 240.

Directing attention now to the inner workings of body 240 of switch 230, the counter is seen to have two contact switches 232 and 234. Contact switch 232 has two wire contacts extending therefrom, wires 236 and 238. Similarly, contact switch 234 has two wire contacts extending therefrom, wires 242 and 244.

Contact switch 232 of switch 230, has leads 241 and 243 extending therefrom, which leads are the electrical connections between switch 232 and a capacitor (not shown) and display 210. Contact switch 234 also has at least one lead 245 extending therefrom, and possibly a second lead 247, for discharging of the capacitor.

Body 240, proximate to and substantially around contact switches 232 and 234, has a lipped opening 250. Opening 250 has a ledge 252 for rotating receipt thereon of outer flange element 262 of rotating contact portion 260.

Rotating contact portion 260 is substantially circular in shape, has an outer flange element 262 which is matingly received within opening 250 of body 260, so that flange 262 is rotatingly received onto ledge 252. Extending away from flange 262 is an annular ridge 264. An outside wall 265 of ridge 264 is substantially in contact with all of wires 236,238,242 and 244 of contact switches 232 and 234, when rotating contact portion 260 rotates. Accordingly, these wires essentially ride along this wall when portion 260 rotates.

As is best seen in FIG. 6, located on and within ridge 264 is a gap 267 in wall 265. Within gap 267 is a metal strip 266. Metal strip 266 has a width at least equivalent to the thicknesses of the wire combinations of wires 236/238 and 242/244, and the distance between these wire combinations. Accordingly, when rotating contact portion 260 rotates in its usually counterclockwise direction (since handle 115 of coin mechanism 100 usually rotates in a clockwise direction), metal strip 266 will at certain intervals touch both of wire combinations 236/238 and/or 242/244; these contacts taking place at different intervals.

When metal strip 266 touches wire combination 236/238, it closes contact between these normally separated wires, thereby causing counter 200 to increase one increment or numeral, which is shown on display 210. At the same time as counter 200 increases one increment/numeral, a capacitor (not shown) of the assembly becomes fully charged. It is only after rotating contact portion 260 rotates further so that metal strip 266 then touches wire combination 242/244 will the capacitor be discharged, and thereby allowing the counter to have the ability of achieving another count. In specific, and the purpose of this invention verses that of its parent application (Ser. No. 08/842,677), and verses the improvements of this application's sister application (Ser. No. 09/065,504), is for security against double counts when the user shakes handle 115 or entire machine 10. In particular, since wire combinations 236/238 and 242/244 are spaced apart, and since the system's capacitor becomes fully charged after wires 236/238 are contacted by metal strip 266, even if handle 115 is roughly jiggled and/or turned back and forth by a user so that metal strip 266 repeatedly leaves and then re-touches wires 236/238, only one count will be registered by counter 200. In addition, and what also helps this double-count protection work, is that coin mechanisms 100 usually are constructed so that after handle 115 turns a certain distance, it cannot go back. Accordingly, if wire combinations 236/238 and 242/244 are separated and placed into two different turning zones of handle 115, then after discharge of the capacitor (which discharge allows counter 200 to make another count), metal strip 266 would not be able to go back and re-touch wire combination 236/238 to cause a double count. The only place for handle 115 and metal strip 266 to go is back to the beginning position of coin mechanism 100, where it is then ready to receive another coin and start the process over again.

Addressing another embodiment of counter 200, we turn attention to counter 300 of FIG. 8. As can be seen counter 300 is substantially identical in construction to counter 200. specifically switch 230 and body 240. but without display 210. Replacing display 210 is Data Compilation/Transfer Device 310.

Data Compilation/Transfer Device 310 (hereinafter referred to as "DCTD 310") in addition to being able to keep track of the number of "vends" for a given bulk vending machine, vending machine, etc. will also be able to story this information on computer chip for later download by the owner/operator. DCTD 310 will also be able to provide other data relevant to the dispensing of "vends" from the machine to an interested owner/operator, such as, day and/or time of particular "vends". particular machine from which the "vend" took place particular location/owner/operator of machine from which each "vend" originated. and allow for multiple hook-up of DCTDs from numerous machines found in one location so as to achieve a report on all "vends."

All of the information available from DCTD 310 will be downloadable through output port 312. The available downloaded material will be able to be transported into any spreadsheet program available on the market.

DCTD 310 also has an input port 314, through which the person setting up the mechanism in the vending machine can input data relevant to the particular location/owner/operator. Presumably such inputted information would also be in whole or in part downloaded with the rest of the data so as to make any report issued therefrom as complete as possible.

It is also to be understood from the invention that DCTD 310 is not necessarily an integrally attached component of counter 300. located within opening 21 of machine 10. In the alternative DCTD 310 may be connected remotely by long lead wires 241, or possibly even through radio transmission, to switch 230. Part of the determination of the location of DCTD 310 will depend upon the user/owner/operator and how he/she will want to access output and input ports 312 and 314.

Since counter 300 is unchanged in how it interacts with mechanism 100 to achieve counts/generate information, the below discussion regarding counter 200's operation relevant to mechanism 100, pertains directly to how counter 300 would so operate.

To further explain the operation of counter 200 with mechanism 100, it must be understood that counter 200 is attached onto coin mechanism 100 in such a way that opening 250 of body 240 is received around shaft 110 of mechanism 100. Body 240 is positioned between either cam 140 and washer 113 of mechanism 100, or between washer 113 and sprocket 150 of mechanism 100. Due to the earlier discussed shape of shaft 110, having one or two flat edge(s) 111A and/or 111B, the rotation of shaft 110 causes rotating portion 260 (closed within and between body 240 and cover 280), to also rotate. This is because (as shown in FIGS. 4–6), rotating portion 260 has a key 270 attached thereto.

Key 270 is attached to ridge 264 by legs 272, which preferably fit within receiving slots in ridge 264. Through the center of rotating portion 260 and key 270 is keyed opening 274. Keyed opening 274 is substantially circular in shape, but having one flat edge 275. It is flat edge 275 which interacts with flat edge 111 (111A or 111B) of shaft 110, and thereby locks the rotation of portion 260 into synchrony with shaft 110 (and therefore handle 115).

Legs 272 of key 270 can have a length which extends opening 274 and edge 275 away from the main body of portion 260 and body 240 of switch 230. The purpose of this versatility in length of legs 272 is to allow counter 200 to be adapted to fit onto the many varied sized and shaped coin mechanisms 100 used in the industry.

Further, as seen in FIGS. 4 and 5, a second keyed opening exists in portion 260: This second keyed opening is opening 277, located not in key 270, but in ridge 264. Opening 277 is used on some coin mechanisms instead of key 270 (although this does not necessarily mean that key 270 must be removed from portion 260). In particular, some coin mechanisms do not use a shaft having a flat surface, but instead having a protruding nipple at and near the end of the shaft, in and around the cam/sprocket portion of the mechanism. The subject invention has been adopted to be usable with these types of mechanisms and make use of these nipples by incorporation of opening 277.

Figure 7:
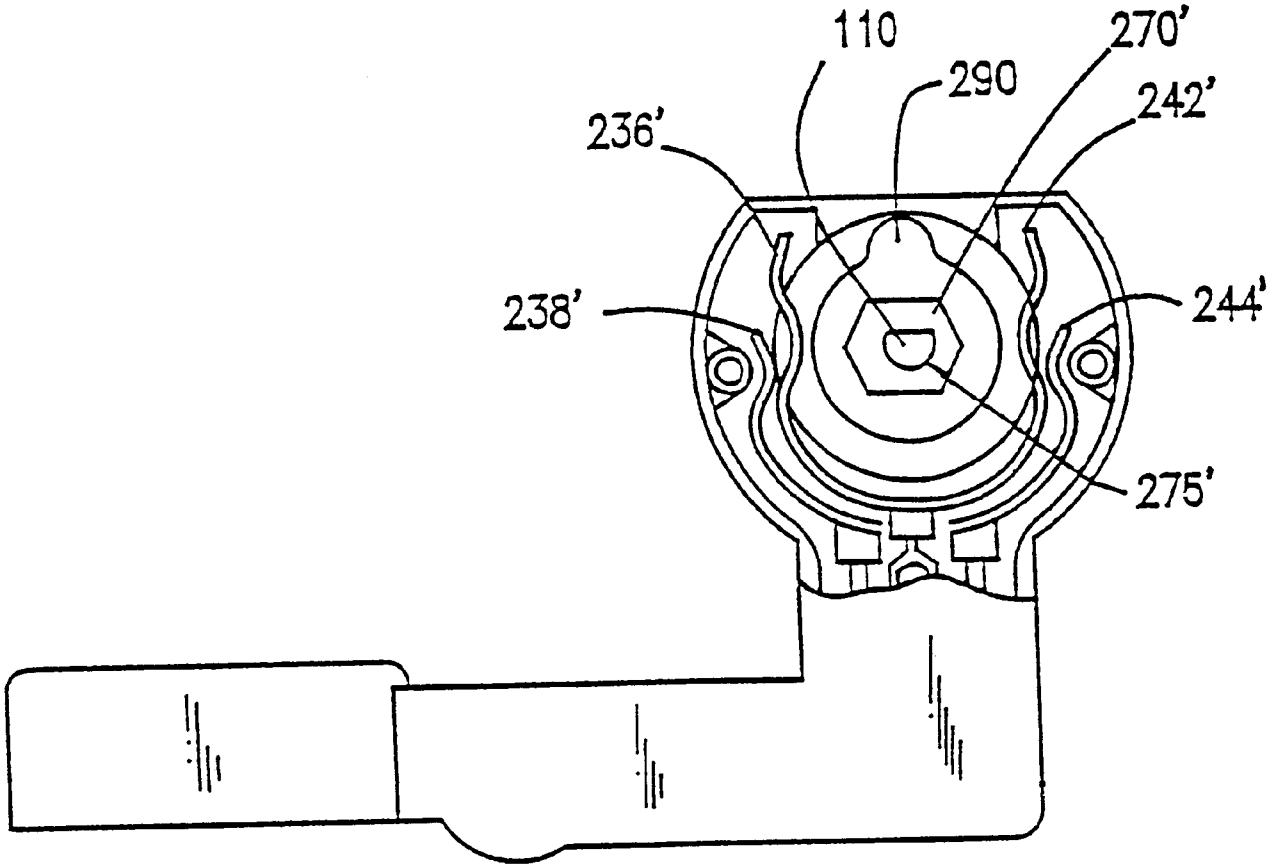
FIG. 7 is a top plan view of another embodiment of the switch mechanism of the counter.

Finally, we turn our attention to the embodiment of FIG. 7. This embodiment substitutes the construction shown for that of FIGS. 4–6. In particular, a cam 290 is used to push wire 236' into wire 238', causing the counting and charging of the capacitor. Thereafter, cam 290 rotates and pushes wire 242' into wire 244', causing the capacitor to discharge. The rotation is allowed by shaft 110 and keyed opening 275' of key 270'. This embodiment can also have the opening 277 of the prior embodiment.

As seen in the figures, the coin mechanism 100 and coin counter 200 combination are substantially equivalent in size to the coin mechanism 100 by itself. In this way, counter 200 is able to be used within all bulk vending machines, in the limited space provided within body 20, between chute shield 26 and rear plate 130.

Since counter 200 is also self-powered by, preferably, a nickel cadmium battery, there is no need to have to position bulk vending machine 10 near an AC power outlet, and the bulk vending industry can continue its practice of positioning these bulk vending machines at inconvenient locations. The lack of an AC power hook-up to power counter 200 also increases the safety of the apparatus, since there is no possibility of electric shock to the users of the bulk vending machines.

Counter 200 is also positioned and oriented so as to be easily readable during normal collection procedures for bulk vending machines.

It will thus be seen that the objects set forth above, among those made apparent from the preceding description, are efficiently attained, and since certain changes may be made in the above constructions without departing from the spirit and scope of the invention, it is intended that all matter contained in the above description and shown in the accompanying drawings shall be interpreted as illustrative, and not in a limiting sense.

It is also to be understood that the following claims are intended to cover all of the generic and specific features of the invention herein described and all statements of the scope of the invention, which, as a matter of language, might be said to fall therebetween.

What is claimed is:

1. For a bulk vending machine, a combination coin mechanism and data generating device, comprising:

a coin mechanism designed to be partially received into an opening in said bulk vending machine, said coin mechanism comprising a selectively rotatable shaft extending substantially axially therefrom;

a contact switch assembly at least a portion of which is located around a portion of said selectively rotatable shaft; and a data compilation/transfer device connected to said contact switch assembly, said contact switch assembly, comprising:

a first pair of spaced-apart wires at a first location of said switch assembly;

a second pair of spaced-apart wires at a second location of said switch assembly; and a selectively rotatable element located substantially between said first and second pairs of spaced-apart wires, comprising a conductive strip, said conductive strip separately contacting both of said first and second pairs of spaced-apart wires when said selectively rotatable element is selectively rotated;

wherein said data compilation/transfer device compiles data at a first contact between said conductive strip and said first pair of spaced-apart wires.

2. A combination coin mechanism and data generating device as recited in claim 1, said first pair of spaced-apart wires connected to said data compilation/transfer device.

3. A combination coin mechanism and data generating device as recited in claim 2, said first pair of spaced-apart wires further connected to a capacitor.

4. A combination coin mechanism and data generating device as recited in claim 3, said second pair of spaced-apart wires connected at least to said capacitor.

5. A combination coin mechanism and data generating device as recited in claim 4, said contact between said conductive strip and said first pair of spaced-apart wires occurring at said first location of said switch assembly, and said contact between said conductive strip and said second pair of spaced-apart wires occurring at said second location of said switch assembly and after said contact between said conductive strip and said first pair of spaced-apart wires.

6. A combination coin mechanism and data generating device as recited in claim 4, wherein said data compilation/transfer device can only compile additional data after said selectively rotatable element rotates, bringing said conductive strip into contact with said second pair of spaced-apart wires.

7. A combination coin mechanism and data generating device as recited in claim 6, comprising a battery connected to said data compilation/transfer device and to said capacitor.

8. A combination coin mechanism and data generating device as recited in claim 7, wherein a circuit is closed at said first contact between said conductive strip and said first pair of spaced-apart wires, causing an electric charge from said battery to cause said data compilation/transfer device to compile data.

9. A combination coin mechanism and data generating device as recited in claim 8, wherein another circuit is closed at said first contact between said conductive strip and said first pair of spaced-apart wires, causing said electric charge from said battery to charge said capacitor.

10. A combination coin mechanism and data generating device as recited in claim 9, wherein said conductive strip contacts said second pair of spaced-apart wires thereby closing yet another circuit, and causing said capacitor to discharge, said discharge of said capacitor enabling said data compilation/transfer device to compile additional data once said conductive strip again contacts said first pair of spaced-apart wires.

11. A combination coin mechanism and data generating device as recited in claim 1, said data compilation/transfer device comprising a data output port.

12. A combination coin mechanism and data generating device as recited in claim 1, said data compilation/transfer device comprising a data input port.

13. A combination coin mechanism and data generating device as recited in claim 1, wherein said selectively rotatable element is located on said portion of said contact switch assembly located around said portion of said selectively rotatable shaft.

14. A counter and data generating assembly, comprising:

a data compilation/transfer device; and a contact switch assembly, comprising:

a first pair of spaced-apart wires at a first location of said switch assembly;

a second pair of spaced-apart wires at a second location of said switch assembly; and a selectively rotatable element located substantially between said first and second pairs of spaced-apart wires, comprising a conductive strip, said conductive strip separately contacting both of said first and second pairs of spaced-apart wires when said selectively rotatable element is selectively rotated;

wherein said data compilation/transfer device compiles data at a first contact between said conductive strip and said first pair of spaced-apart wires.

15. A counter and data generating assembly as recited in claim 14, said first pair of spaced-apart wires connected to said data compilation/transfer device.

16. A counter and data generating assembly as recited in claim 15, said first pair of spaced-apart wires further connected to a capacitor.

17. A counter and data generating assembly as recited in claim 16, said second pair of spaced-apart wires connected at least to said capacitor.

18. A combination coin mechanism and data generating device as recited in claim 17, said contact between said conductive strip and said first pair of spaced-apart wires occurring at said first location of said switch assembly, and said contact between said conductive strip and said second pair of spaced-apart wires occurring at said second location of said switch assembly and after said contact between said conductive strip and said first pair of spaced-apart wires.

19. A combination coin mechanism and data generating device as recited in claim 17, wherein said data compilation/transfer device can only compile additional data after said selectively rotatable element rotates, bringing said conductive strip into contact with said second pair of spaced-apart wires.

20. A combination coin mechanism and data generating device as recited in claim 19, comprising a battery connected to said data compilation/transfer device and to said capacitor.

21. A combination coin mechanism and data generating device as recited in claim 20, wherein a circuit is closed at said first contact between said conductive strip and said first pair of spaced-apart wires, causing an electric charge from said battery to cause said data compilation/transfer device to compile data.

22. A combination coin mechanism and data generating device as recited in claim 21, wherein another circuit is closed at said first contact between said conductive strip and said first pair of spaced-apart wires, causing said electric charge from said battery to charge said capacitor.

23. A combination coin mechanism and data generating device as recited in claim 22, wherein said conductive strip contacts said second pair of spaced-apart wires thereby closing yet another circuit, and causing said capacitor to discharge, said discharge of said capacitor enabling said data compilation/transfer device to compile additional data once said conductive strip again contacts said first pair of spaced-apart wires.

24. A combination coin mechanism and data generating device as recited in claim 14, said data compilation/transfer device comprising a data output port.

25. A combination coin mechanism and data generating device as recited in claim 14, said data compilation/transfer device comprising a data input port.

26. A combination coin mechanism and data generating device as recited in claim 14, wherein said selectively rotatable element is located on said portion of said contact switch assembly located around said portion of said selectively rotatable shaft.

27. For a bulk vending machine, a combination coin mechanism and data generating device, comprising:

a coin mechanism designed to be partially received into an opening in said bulk vending machine, said coin mechanism comprising a selectively rotatable shaft extending substantially axially therefrom;

a contact switch assembly at least a portion of which is located around a portion of said selectively rotatable shaft; and a data compilation/transfer device connected to said contact switch assembly, said contact switch assembly, comprising:

a first pair of spaced-apart wires at a first location of said switch assembly;

a second pair of spaced-apart wires at a second location of said switch assembly; and a selectively rotatable cam element located substantially between said first and second pairs of spaced-apart wires;

wherein rotation of said selectively rotatable cam element pushes a first wire of said first pair of spaced-apart wires into a first contact with a second wire of said first pair of spaced-apart wires, causing said data compilation/transfer device to compile data.

28. A combination coin mechanism and data generating device as recited in claim 27, said second wire of said first pair of spaced-apart wires connected to said data compilation/transfer device.

29. A combination coin mechanism and data generating device as recited in claim 28, said second wire of said first pair of spaced-apart wires further connected to a capacitor.

30. A combination coin mechanism and data generating device as recited in claim 29, wherein said data compilation/transfer device can only compile additional data after said selectively rotatable cam element further rotates, pushing a first wire of said second pair of spaced-apart wires into contact with a second wire thereof.

31. A combination coin mechanism and data generating device as recited in claim 30, wherein said second wire of said second pair of spaced-apart wires is connected at least to said capacitor.

32. A combination coin mechanism and data generating device as recited in claim 31, further comprising a battery connected to said data compilation/transfer device and to said capacitor.

33. A combination coin mechanism and data generating device as recited in claim 32, wherein a circuit is closed when said selectively rotatably cam element pushes said first wire of said first pair of spaced-apart wires into said first contact with said second wire of said first pair of spaced-apart wires, causing said data compilation/transfer device to compile data from receipt of an electric charge from said battery.

34. A combination coin mechanism and data generating device as recited in claim 33, wherein another circuit is closed when said selectively rotatably cam element pushes said first wire of said first pair of spaced-apart wires into said first contact with said second wire of said first pair of spaced-apart wires, causing said electric charge from said battery to charge said capacitor.

35. A combination coin mechanism and data generating device as recited in claim 34, wherein said selectively rotatably cam element pushes said first wire of said second pair of spaced-apart wires into contact with said second wire of said second pair of spaced-apart wires, closing yet another circuit, and causing said capacitor to discharge, said discharge of said capacitor enabling said data compilation/transfer device to compile additional data once said selectively rotatably cam element again pushes said first wire of said first pair of spaced-apart wires into contact with said second wire of said first pair of spaced-apart wires on its next selective rotation.

36. A combination coin mechanism and data generating device as recited in claim 27, said data compilation/transfer device comprising a data output port.

37. A combination coin mechanism and data generating device as recited in claim 27, said data compilation/transfer device comprising a data input port.

38. A counter and data generating assembly, comprising:

a data compilation/transfer device; and a contact switch assembly, comprising:

a first pair of spaced-apart wires at a first location of said switch assembly;

a second pair of spaced-apart wires at a second location of said switch assembly; and a selectively rotatable cam element located substantially between said first and second pairs of spaced-apart wires;

wherein rotation of said selectively rotatable cam element pushes a first wire of said first pair of spaced-apart wires into a first contact with a second wire of said first pair of spaced-apart wires, causing said data compilation/transfer device to compile data.

39. A counter and data generating assembly as recited in claim 38, said second wire of said first pair of spaced-apart wires connected to said data compilation/transfer device.

40. A counter and data generating assembly as recited in claim 39, said second wire of said first pair of spaced-apart wires further connected to a capacitor.

41. A counter and data generating assembly as recited in claim 40, wherein said data compilation/transfer device can only compile additional data after said selectively rotatable cam element further rotates, pushing a first wire of said second pair of spaced-apart wires into contact with a second wire thereof.

42. A counter and data generating assembly as recited in claim 40, wherein said second wire of said second pair of spaced-apart wires is connected at least to said capacitor.

43. A counter and data generating assembly as recited in claim 42, further comprising a battery connected to said data compilation/transfer device and to said capacitor.

44. A counter and data generating assembly as recited in claim 43, wherein a circuit is closed when said selectively rotatably cam element pushes said first wire of said first pair of spaced-apart wires into said first contact with said second wire of said first pair of spaced-apart wires, causing said data compilation/transfer device to compile data from receipt of an electric charge from said battery.

45. A counter and data generating assembly as recited in claim 44, wherein another circuit is closed when said selectively rotatably cam element pushes said first wire of said first pair of spaced-apart wires into said first contact with said second wire of said first pair of spaced-apart wires, causing said electric charge from said battery to charge said capacitor.

46. A counter and data generating assembly as recited in claim 45, wherein said selectively rotatably cam element pushes said first wire of said second pair of spaced-apart wires into contact with said second wire of said second pair of spaced-apart wires, closing yet another circuit, and causing said capacitor to discharge, said discharge of said capacitor enabling said data compilation/transfer device to compile additional data once said selectively rotatably cam element again pushes said first wire of said first pair of spaced-apart wires into contact with said second wire of said first pair of spaced-apart wires on its next selective rotation.

47. A counter and data generating assembly as recited in claim 38, said data compilation/transfer device comprising a data output port.

48. A counter and data generating assembly as recited in claim 38, said data compilation/transfer device comprising a data input port.

* * * * *